United States Patent [19]

Northcutt, Jr. et al.

[11] 3,979,234

[45] Sept. 7, 1976

[54] PROCESS FOR FABRICATING ARTICLES OF TUNGSTEN-NICKEL-IRON ALLOY

[75] Inventors: Walter G. Northcutt, Jr., Oak Ridge; William B. Snyder, Jr., Knoxville, both of Tenn.

[73] Assignee: The United States of America as represented by the United States Energy Research and Development Administration, Washington, D.C.

[22] Filed: Sept. 18, 1975

[21] Appl. No.: 614,458

[52] U.S. Cl. ..... 148/126; 75/200; 75/221; 75/225

[51] Int. Cl.[2] ..... B22F 3/16; B22F 3/24

[58] Field of Search ..... 75/200, 221, 225; 148/126

[56] References Cited

UNITED STATES PATENTS 3,695,868 10/1972 Norris et al. ..... 148/126

FOREIGN PATENTS OR APPLICATIONS 760,113 10/1956 United Kingdom

*Primary Examiner*—Brooks H. Hunt

*Attorney, Agent, or Firm*—Dean E. Carlson; David S. Zachry; Allen H. Uzzell

[57] ABSTRACT

A high density W—Ni—Fe alloy of composition 85–96% by weight W and the remainder Ni and Fe in a wt. ratio of 5:5–8:2 having enhanced mechanical properties is prepared by compacting the mixed powders, sintering the compact in reducing atmosphere to near theoretical density followed by further sintering at a temperature where a liquid phase is present, vacuum annealing, and cold working to achieve high uniform hardness.

7 Claims, No Drawings

PROCESS FOR FABRICATING ARTICLES OF TUNGSTEN-NICKEL-IRON ALLOY

BACKGROUND OF THE INVENTION

This invention was made in the course of or under a contract with the Energy Research and Development Administration. It relates to a method of preparing a high density W—Ni—Fe alloy and more particularly to a method for fabricating articles of such an alloy. The alloy of the present invention is particularly useful for armor penetrating projectiles (penetrators).

Because of its high melting point, density and other physical properties, tungsten is an attractive material for the fabrication of penetrators. Pure W, however, requires high sintering temperature and is entirely too brittle to be effective as a penetrator. It is therefore necessary that W be alloyed with other elements in order to improve its mechanical properties. The present invention provides an alloy of enhanced effectiveness as an armor penetrator.

An armor penetrating projectile (penetrator) is a bullet fabricated of a material with a high penetrating ability and adapted for firing from a rifle or cannon. Penetrators are sometimes sheathed with steel, however, it is generally preferable that they be effective without sheating. Typically, a penetrator is of ordinary oblong bullet shape, elliptical, blunt, or pointed at its leading end and adapted at its trailing end for assembly with its means of propulsion, e.g. a shell casing with explosive charge or a rocket arrangement of the recoilless rifle ammunition type. The measure of effectiveness for a penetrator (its penetrating ability) is the thickness of various armor which may be penetrated by the projectile at a particular velocity. Therefore, the greater the penetrating ability of a penetrator the greater its effective range and the lower the required muzzle velocity.

PRIOR ART

The art of fabricating materials for use as armor penetrators has not yet reached a high degree of refinement. That is, the exact combination of physical properties desirable in a penetrator has not been precisely determined, so the effectiveness of a material as a penetrator must be determined by trial-and-error testing against simulated targets. Research in the art is largely carried out by fabricating penetrators of various compositions and fabrication techniques followed by test firings to determine if the penetrating effect has been enhanced or decreased.

It is generally accepted in the art that an effective armor piercing projectile must have high tensile strength, density, and hardness, yet sufficient ductility to prevent the projectile from fragmenting prior to complete penetration. Furthermore, due to the exigencies of warfare, it is important that penetrators be of reproducible effectiveness, so it is highly desirable that the material of fabrication be of uniform strength, hardness, and ductility throughout.

In the prior art it has been difficult to achieve sufficient penetrating ability in W—Ni—Fe alloy penetrators. Compacted blended powders have been sintered to provide a high tungsten alloy of substantially 100% theoretical density by conventional solid state sintering techniques, but this alloy becomes excessively brittle when subjected to the extensive cold working required to achieve the necessary hardness (about 40 on the Rockwell C scale). Furthermore, even after cold working, the prior art alloy did not exhibit uniform hardness throughout its thickness and was generally unsuitable for penetrator applications. A dense W—Ni—Fe alloy which can be cold worked to a high uniform hardness (at least 40 ± 1 on Rockwell C scale) and strength, yet retain substantial ductility has long been needed.

SUMMARY OF THE INVENTION

It is an object of this invention to provide a dense W—Ni—Fe alloy having high tensile strength, high uniform hardness, and sufficient ductility for armor penetrator applications.

It is a further object to provide a method for fabricating articles of this alloy.

It is a further object to provide a highly effective armor penetrating projectile.

It is a further object to provide a method of enhancing the penetrating ability of a sintered W—NI—Fe article.

These and other objects are accomplished by providing a method of fabricating article of W—Ni—Fe alloy comprising providing a uniformly blended mixed powder of 85–95% by weight W, the remainder Ni and Fe in a weight ratio of 5:5–8:2, pressing the powder mixture into a compact, sintering the compact in a reducing atmosphere at a temperature of 1200°–1420°C to provide an article having at least 95% theoretical density, further heating the article to a temperature of 0.1°–20°C above the liquid phase temperature for a period of time sufficient to cause the formation of a liquid phase yet insufficient to cause slumping of the article, and vacuum annealing the article by maintaining the article in a vacuum at 700°–1420°C for sufficient time to remove entrapped gases, and cold working the article.

DETAILED DESCRIPTION

The subject invention, in its method aspects, is a series of distinct operations which when carried out sequentially, have been found to result in the production of an alloy which is fabricable into a very highly effective armor penetrator. Aside from its weapons application, the alloy is useful for radiation shielding, counterweights, vibration dampers and the like.

The method of fabricating this alloy will be illustrated generally giving the critical considerations, followed by examples of preferred parameters. The starting materials are tungsten, nickel, and iron powders, preferably of high purity. The particle size is not critical, but the particles must be sufficiently fine to be uniformly mixed, compacted, and sintered to above 95% theoretical density by solid state sintering (sintering in which no liquid phase is present). The powders may be uniformly blended by any conventional means. The uniformity of the blend must be such that classification of the powders does not occur and cause tungsten rich areas in the finished product. The composition of the blend is determined somewhat by the parameters of the process and the desired properties of the finished article. Generally speaking, the composition will be 85–96% wt. W, with the remainder Ni and Fe in Ni—Fe weight ratio of from 5:5 to 8:2. A tungsten content of less than 85% would result in slumping of the articles during liquid phase sintering and a tungsten content of greater than 96% would not contain enough liquid phase to impart the desired ductility to the article. The 5:5 Ni—Fe ratio produces better ductility as sintered, but when the article is vacuum annealed, the higher ratios up to about 8:2 produce improved ductility, with a 7:3 Ni—Fe weight ratio providing maximum ductility for a given tungsten concentration.

The blended powder is loaded into a flexible plastic bag for containment during pressing (polyvinyl chloride for example). The bag is loaded into a conventional isostatic press where it is cold pressed until the powder forms a compact. Because the compact will be liquid-phase sintered, the pressure and time for pressing are not critical to the ultimate density, 10,000 psi pressure for a few seconds being sufficient to form a suitable compact. The compact (with plastic removed) is then placed into a sintering furnace. It has been found that a carbon-free atmosphere during sintering is essential to the ductility of the finished alloy, so carbon susceptors in the sintering furnace of the examples were replaced with tungsten. In the sintering furnace, the compact is first heated in a reducing atmosphere, preferably hydrogen to reduce impurities present. The flowing hydrogen removes impurities and reduces oxides from the pressed compact while it is still porous, before the liquid phase can entrap them. About four hours at 900°C was sufficient for the articles of the subsequent examples. Larger articles or lower temperatures would require a longer time.

The furnace temperature is then increased to sintering temperature, at least 1200°C. The article is sintered in the solid state in a reducing atmosphere preferably hydrogen until greater than 95% theoretical density is achieved. This may be accomplished by heating to 1400°C for 4 hours, or significantly longer for lower sintering temperatures. The sintering time necessary to reach the required densification at lower temperature or for different sized articles may be determined by routine experimentation. What is critical is that at least 95% theoretical density be achieved by solid state sintering prior to the appearance of a liquid phase. The formation of the liquid phase is detectable by thermocouples disposed within a block of the pressed alloy which is sintered alongside the article and is therefore at the same temperature as the article. If the thermocouple is connected to a recorder, a temperature vs. time chart will indicate the liquid phase formation by a change in heating rate due to an endotherm as the furnace temperature is increased.

The liquid phase is called matrix alloy and is distributed around the tungsten particles of the sintered article. The matrix alloy has a composition of 50–60 wt. % Ni, 20–25 wt. % Fe, and 15–25 wt. % W. It has been found according to this invention that the matrix alloy, when liquid, has a distinct tendency to migrate from hotter zones to cooler non-liquid zones. This migration of nickel-rich alloy has been found to result in tungsten-rich zones which cause brittleness in the final article. It was not until we discovered this problem of matrix alloy migration that we were able to remedy the excessive brittleness of liquid phase sintered W—Ni—Fe alloy.

According to this invention, it has been found that the ductility of the alloy and its ability to withstand the necessary cold working without embrittlement is greatly increased when the alloy is sintered in hydrogen atmosphere to greater than 95% theoretical density by solid state sintering prior to the appearance of the liquid phase. It is believed that by sintering the article to near theoretical density prior to the formation of the liquid phase, the matrix alloy migration is minimized.

When the article is solid state sintered to greater than 95% theoretical density, the porosity consists of small isolated pores throughout the article. During the critical time period of liquid phase formation, when the article is not in thermal equilibrium, the tendency for the matrix alloy to migrate is reduced due to the presence of only small isolated pores. It is believed that this phenomenon accounts for the increased strength and ductile behavior of the finished article.

Accordingly, after solid state sintering, the temperature of the furnace is increased to slightly above liquid phase formation temperature. All that is required is that the temperature increase to above the liquid phase temperature. An increase of 0.1°C above the liquid phase temperature is sufficient, but more that 20°C above would cause slumping of the article. About 10° ± 2°C above the liquid phase temperature ensures complete sintering without slumping of the article. The duration of liquid phase sintering should be about 1 to 2 hours. The time must be sufficient to allow the formation of the liquid phase throughout the article, yet insufficient to cause the article to become too liquid and lose its structural integrity (slumping). This slumping occurs when the liquid phase sintering is carried out at too high a temperature or for too long a time. It is evidenced by a change in shape, usually flattening, of the cylindrical articles. After about two hours of liquid phase sintering, the article is allowed to cool. The article has now reached a density in excess of 99% theoretical.

It has been found that the ductility of the alloy (particularly the higher Ni—Fe ratio alloy) can be increased significantly by vacuum annealing after sintering. This vacuum annealing removes entrapped gases (mostly $H_2$) which cause embrittlement. The annealing temperature may be from 700°–1400°C depending upon the duration and the thickness of the article. For a particular annealing temperature, the time required will increase with the cross-sectional area of the article. After vacuum annealing, the article is very dense and somewhat ductile, exhibiting about 30% elongation. This high density ductile alloy is useful for a variety of applications such as radiation shielding, counterweights, vibration damping and the like.

In order to harden and strengthen the material for penetrator applications, it is cold worked. Swaging has been found to be a preferred process for armor penetrators, however other cold working processes may be used to impart the desired properties to the material. It has been found that the vacuum annealed article may be cold worked to a hardness of 40 on the Rockwell C (Rc) scale yet exhibit elongation of 14%. Furthermore, the hardness is highly uniform throughout this article, exhibiting uniformity of ± 1 Rockwell C unit throughout the diameter of the article. This high uniform hardness, which is most desirable for penetrators, is most surprising since prior experience with alloys of this composition had shown that such hardness was only attainable at the expense of practically all of the ductility, and was not uniform throughout the thickness of the article. The article may now be machined to the desired dimensions. The following examples will demonstrate operative preferred embodiments. Those skilled in the art can, with the benefit of this disclosure, vary the sintering times for different sized articles.

EXAMPLE I

Tungsten (360 kg.), nickel (28 kg.) and iron (12 kg.) powders were screened to remove large aggregates and added to a dry blender of conventional type with an intensifier bar. The tungsten powder had an average particle diameter of about 0.6 microns and was screened through a 200-mesh sieve. The nickel and iron powders had average particle sizes of 5 and 6 microns respectively and were each screened through a 325 mesh sieve. The screening was to remove large particles and agglomerates which tend to cause voids in the finished articles. The three powders were blended for 30 minutes using the intensifier bar 1 minute out of each 5 minute period.

In preparation for the compacting operation, 8 charges of the blended powder having individual weights of 10 kg. were loaded into cylindrical Unichrome (trademarked polyvinyl chloride) bags having a 2.5 inch diameter and a length of 25 inches. After the powder was loaded, the bags were outgassed to remove air, placed in a pressure vessel and isostatically compacted at room temperature at a pressure of 30,000 psi.

The rod-shaped compacts were removed from the bags and placed in a conventional induction furnace. The as-pressed dimensions were 2 in. diameter × 21 in. length. Prior to vacuum annealing, the sintering is carried out in flowing hydrogen. The hydrogen was bubbled through water at 78°F. to saturate it with water vapor. It was found that this eliminated blistering in the final article. The flow rate of hydrogen is not critical, but it is preferred that the hydrogen not cause cooling of the article during sintering. This may be avoided by introducing the hydrogen into the furnace at a point remote from the articles or by preheating the hydrogen. The sintering cycle was carried out as follows:

1. Heat to 900°C at 450°C/hr.
2. Hold at 900°C for 4 hours (to reduce impurities).
3. Heat to 1400°C at 75°C/hr.
4. Hold at 1400°C for 4 hours.
5. Heat at 40°C/hr to 10°C above the liquid phase temperature, approximately 1440°C, (as indicated by W-3 Re v W-25 Re thermocouples which are inserted into alumina thermocouple tubes in blocks of the pressed alloy to be sintered.)
6. Hold for 1 hour. Cool in $H_2$ to 1100°C, change to helium purge and cool to room temperature.
7. The furnace is then evacuated and the temperature increased to 1200°C for 12 hours. The vacuum was measured as 0.5 torr.

It is not necessary that the article be cooled prior to vacuum annealing, only that the furnace be evacuated and the temperature reduced below the liquid phase temperature.

Density measurements after the solid-state sintering operation indicated a density of 16.8 gm/cc. which is 98% theoretical density. After the liquid phase-sintering operation the density increased to 17.0 gm/cc. which is 99% theoretical density. The approximate dimensions of the rods after liquid-phase sintering were 1.63 inches in diameter and 17 inches in length.

The sintered rods were then machined to a length of 17.0 inches and a diameter of 1.21 inches in preparation for the swaging operation. The swaging was carried out on a Feen 6F 4 die rotary swager. As the rods were swaged, they became lengthened and reduced in cross-sectional area. Swaging was performed cold and normally required two dies to obtain the desired reductions, 1.100 in and 1.025 in. diameter. The percent swaging reduction is the percent reduction in cross-sectional area.

EXAMPLE II

Rods of like dimensions were made by the procedure of Example I except the initial concentration of the powder blend was 95 wt. % W-3.5 wt. % Ni and 1.5 wt. % Fe. The density of the rods after the solid state sintering operation was 17.8 gm/cc. which is 98% theoretical density. The density of the rods was increased to 18.1 gm/cc. with the liquid phase sintering operation.

Table I presents comparative mechanical property data for unswaged articles. Four tensile sample (1,2,3,4) were taken from articles A, B, and C. Articles A and B were prepared as in Example I but without the 4 hour sintering at 1400°C; that is, the articles were heated directly to above liquid phase temperature without having reached at least 95% theoretical density. Article C was prepared as in Example I.

Table I illustrates the higher, more uniform elongation and ultimate tensile strength of articles prepared by the method of this invention with respect to articles prepared where matrix alloy migration occurs during liquid phase sintering. The ductile properties of Article C became more uniform after swaging to a 23.0% reduction. The mean % elongation was 11.4 with a 1.3 standard deviation and the mean % reduction in area from the tensile test was 26.1 with a standard deviation of 2.5.

Table II presents mechanical property data versus percent swaging reduction (cross-sectional area) for the articles prepared in Examples I and II. The tensile tests shown in Tables I and II were performed using unthreaded specimens having a 0.250 in. gage length. The testing was performed using a Tinius Olsen 30,000 lb. capacity machine. Specimens were tested at 0.005/min. strain rate to yield. After yield, testing was completed to fracture at a constant crosshead speed of 0.05 in./min.

TABLE I

| | Mechanical Property Data for Unswaged W-7Ni-3Fe Alloy | | | |
|---|---|---|---|---|
| Sample | Ultimate Tensile Strength (Psi × $10^3$) | 0.2% Yield Strength (Psi × $10^3$) | Elongation % (From Tensile Test) | Reduction in Area % (From Tensile Test) |
| $A_1$[1] | 99.0 | 78.9 | 6.6 | 9.8 |
| $A_2$ | 108.8 | 82.8 | 10.5 | 15.7 |
| $A_3$ | 105.1 | 82.4 | 7.2 | 13.1 |
| $A_4$ | 124.2 | 82.7 | 42.0 | 41.3 |
| mean | 109.3 | 81.7 | 16.6 | 20.0 |
| standard deviation | 9.4 | 1.6 | 14.8 | 12.5 |
| $B_1$[1] | 128.0 | 85.7 | 34.0 | 31.1 |
| $B_2$ | 100.6 | 80.2 | 1.0 | 11.6 |
| $B_3$ | 119.8 | 79.0 | 14.8 | 16.4 |
| $B_4$ | 99.5 | 79.3 | 4.8 | 11.2 |
| mean | 112.0 | 81.0 | 13.6 | 17.6 |

TABLE I-continued

| Sample | Mechanical Property Data for Unswaged W-7Ni-3Fe Alloy: Ultimate Tensile Strength (Psi × $10^3$) | 0.2% Yield Strength (Psi × $10^3$) | Elongation % (From Tensile Test) | Reduction in Area % (From Tensile Test) |
|---|---|---|---|---|
| standard deviation | 11.7 | 2.7 | 12.8 | 9.2 |
| $C_1$[2] | 131.1 | 83.4 | 19.0 | 15.7 |
| $C_2$ | 130.3 | 81.7 | 34.0 | 39.6 |
| $C_3$ | 131.9 | 85.2 | 32.0 | 37.6 |
| $C_4$ | 130.8 | 86.0 | 31.0 | 38.6 |
| mean | 131.0 | 84.1 | 29.0 | 32.9 |
| standard deviation | 0.5 | 1.6 | 5.9 | 9.9 |

[1]Prepared as in Example I without 4 hour hold at 1400°C.
[2]Prepared as in Example I Table II

| Swaging Reduction % | Properties of A W-7N1-3Fe Alloy As a Function of Reduction in Area by Swaging: Ultimate Tensile strength (Psi × $10^3$) | 0.2% Yield strength (Psi × $10^3$) | Elongation % (From Tensile Test) | Reduction in Area % (From Tensile Test) | Elastic Modulus Psi × $10^6$) | Hardness Rc |
|---|---|---|---|---|---|---|
| 0 | 131.0 | 84.1 | 29.0 | 32.9 | — | 26 |
| 5.3 | 137.9 | 118.8 | 23.5 | 38.6 | 45.7 | 34 |
| 11.7 | 150.9 | 142.7 | 16.3 | 33.4 | 48.7 | 39 |
| 17.0 | 159.3 | 150.4 | 14.2 | 27.8 | 48.2 | 40 |
| 23.0 | 166.4 | 161.1 | 11.4 | 26.1 | 48.9 | 42 |
| 31.0 | 176.8 | 170.9 | 7.8 | 22.9 | 49.4 | 41 |

Table 2

| | | | W-3.5N1-1.5Fe | | | |
|---|---|---|---|---|---|---|
| 0 | 128.4 | 86.9 | 28.9 | 26.0 | 54.4 | 28 |
| 3.2 | 131.1 | 105.6 | 16.5 | 14.3 | 54.2 | 31 |
| 9.5 | 149.2 | 144.0 | 14.1 | 20.1 | 58.5 | 38 |
| 17.8 | 165.0 | 156.0 | 6.8 | 14.1 | 51.3 | 41 |

It is seen from Table II that the desired ductility, strength, and hardness can be attained by varying the amount of cold working reduction. While the cold work is done at room temperature, it may be performed similarly at higher temperatures. For purposes of this disclosure, the term cold working refers to plastic deformation resulting in grains in a distorted condition.

Hardness measurements made along diameters of cross sections of the swaged bars indicated highly uniform hardness throughout the thickness (± 1 Rc unit). This uniform hardness indicates a uniform tensile strength as well. Armor penetrators prepared according to the method of this invention and swaged to a uniform (± 1 Rc unit) hardness of 40 or more on the Rc scale have proven to be much more effective as armor penetrators than have alloys of similar composition and density. This invention thus provides the art with a method of enhancing the penetrating ability of a sintered W—Ni—Fe article. Tests performed against simulated targets by the U.S. Army Ballistics Research Laboratories, Aberdeen Proving Ground, Md. have demonstrated that penetrators fabricated according to the method of this invention have excellent penetrating ability. The greatest penetrating effect has thus far been achieved with the 90 wt. % W-7 wt. % Ni-3 wt. % Fe alloy prepared according to Example I and swaged to about 25% reduction and exhibiting hardness of 42 ±1 on Rc scale.

What is claimed is:

1. A method of fabricating articles of W—Ni—Fe alloy comprising:

a. providing a uniformly blended mixed powder of 85–96% by weight W and the remainder Ni and Fe in a Ni—Fe weight ratio of 5:5–8:2, b. pressing said powder into a compact, c. sintering said compact in reducing atmosphere at a temperature at least 1200°C and below the liquid phase temperature for a period of time sufficient to provide an article of at least 95% theoretical density, d. further heating the article to a temperature 0.1°–20°C above the liquid phase temperature for a period of time sufficient to cause the formation of a liquid phase, yet insufficient to cause slumping of the article, e. vacuum annealing the article by maintaining the article in a vacuum at 700°–1420°C for sufficient time to remove entrapped gases, and f. machining the article to the desired dimensions.

2. The method of claim 1 further comprising, after vacuum annealing and prior to the machining step, cold working the article to the desired hardness.

3. The method of claim 1 in which the sintering steps are carried out in $H_2$ atmosphere.

4. The method of claim 2 in which the sintering steps are carried out in $H_2$ atmosphere and said cold working is accomplished by swaging the article to a reduction of 25% to cause the article to exhibit uniform (±1 Rc unit) hardness of 42 on the Rockwell C scale.

5. An armor penetrating projectile having a composition of 90 wt. % W, 7 wt. % Ni and 3 wt. % Fe fabricated by the method of claim 4.

6. A method of enhancing the penetrating ability of a sintered W—Ni—Fe article comprising fabricating the article by the method of claim 4.

7. The method of claim 6 in which the composition of the article is 90% by weight W, 7% by weight Ni, and 3% by weight Fe.

* * * * *